US006901228B2

(12) United States Patent
Kamimura et al.

(10) Patent No.: US 6,901,228 B2
(45) Date of Patent: May 31, 2005

(54) DEVELOPING AGENT CONTAINER INCLUDING A SEALING ELEMENT FOR PREVENTING DEVELOPING AGENT FROM LEAKING OUT

(75) Inventors: Naoya Kamimura, Nagoya (JP); Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 233 days.

(21) Appl. No.: 10/106,238

(22) Filed: Mar. 27, 2002

(65) Prior Publication Data

US 2002/0141777 A1 Oct. 3, 2002

(30) Foreign Application Priority Data

Mar. 27, 2001 (JP) ..... 2001-089059
Sep. 27, 2001 (JP) ..... 2001-298629

(51) Int. Cl.[7] ..... G03G 15/08
(52) U.S. Cl. ..... 399/103
(58) Field of Search ..... 399/103, 104, 399/105, 106

(56) References Cited

U.S. PATENT DOCUMENTS 5,274,425 A * 12/1993 Fukumoto et al. ..... 399/106
5,303,008 A * 4/1994 Kalyandurg et al.
5,655,178 A * 8/1997 Ishikawa et al. ..... 399/103 X
6,070,027 A * 5/2000 Kawai et al. ..... 399/103
6,115,566 A * 9/2000 Ohara et al. ..... 399/103
6,181,897 B1 * 1/2001 Kawai ..... 399/103
6,195,515 B1 * 2/2001 Fujita et al. ..... 399/103
6,336,014 B1 * 1/2002 Sato et al. ..... 399/103
6,356,723 B1 * 3/2002 Sato et al. ..... 399/103
6,473,577 B1 * 10/2002 Higeta et al. ..... 399/103 X
6,498,914 B2 * 12/2002 Hashimoto et al. ..... 399/103

FOREIGN PATENT DOCUMENTS

EP 1079279 * 2/2001
JP 7-295377 * 11/1995
JP 11-194612 * 7/1999

* cited by examiner

*Primary Examiner*—Fred Braun
(74) *Attorney, Agent, or Firm*—Oliff & Berridge, PLC

(57) ABSTRACT

A developing agent container includes a housing having a feeding element that feeds a developing agent and a sealing element made of felt of polyester-base fibers to prevent toner leakage from both ends of a developing roller with respect to an axial direction when mounted in position. The sealing element may be made of a fabric formed with weaving seams. Assembling of the developing agent container includes placing the sealing element at an end of the inside of the housing and placing the feeding element on the sealing element in a direction that the feeding element feeds the developing agent.

39 Claims, 17 Drawing Sheets

17

DEVELOPING AGENT CONTAINER INCLUDING A SEALING ELEMENT FOR PREVENTING DEVELOPING AGENT FROM LEAKING OUT

BACKGROUND OF THE INVENTION

1. Field of Invention

The invention relates to an electrophotographic image forming apparatus, such as a laser printer.

2. Description of Related Art

Electrophotographic image forming apparatus are well known in the art. These devices, such as a laser printer, typically include a photosensitive drum, a charger, a laser scanner, a developing roller, and a transfer roller. After the surface of the photosensitive drum is uniformly charged by the charger, the surface of the photosensitive drum is irradiated with a laser beam emitted from the laser scanner, and an electrostatic latent image is formed based on predetermined image data.

Toner carried on the developing roller is supplied to the electrostatic latent image formed on the surface of the photosensitive drum. The toner deposited on the surface of the photosensitive drum is transferred to a sheet passing between the photosensitive drum and the transfer roller.

The developing roller is rotatably attached to a developing cartridge. The developing cartridge is provided with sealing elements to prevent toner from leaking from both ends of the developing roller with respect to an axial direction thereof. The sealing elements are placed so as to make sliding contact with the circumferential surface of the developing roller, at both ends of the inside of the developing cartridge with respect to the axial direction of the developing roller when mounted in the developing cartridge in position.

SUMMARY OF THE INVENTION

As a sealing element, felt made of Teflon® fiber is used to ensure a pressing force to a developing roller and reduce torque of the developing roller. Teflon® is a trade name of DuPont and refers to polytetrafuluoethylene.

The felt is made of thick Teflon® fibers. If a laser printer is used over a prolonged period, although torque of the developing roller can be reduced, Teflon® fibers are liable to come off due to abrasion. If fibers come off, toner passing in between the developing roller and the felt may leak. Such a problem is prone to occur, especially when the developing roller is rotated at a high speed, because felt made of Teflon® fibers is brittle and tends to be torn.

This invention provides an apparatus to prevent toner leakage when the apparatus is used for a long term and at a high speed.

In an aspect of the invention, to prevent toner as a developing agent from leaking from a housing, sealing elements are made of polyester-base fibers. Polyester-base fibers are excellent in wear resistance and durability, thus, the sealing elements resist damage.

The fibers have a thickness of smaller than or equal to 2.1 times as large as a mean particle diameter of toner, and include at least two different kinds of fibers in thickness, fine and thick fibers. The thickness greatly relates to a degree of which the sealing elements can catch toner. By inclusion of at least two different kinds of fibers in thickness, the fibers can be tangled in more intimate contact with each other. Any factor greatly contributes to an effect of prevention against toner leakage. Fine fiber can prevent the sealing elements from suffering damage, and thick fiber can prevent the reduction of the strength due to abrasion caused by the sliding contact between the developing roller and the sealing elements.

To prevent the sealing elements from suffering damage, it is preferable that the fine fiber constitutes 30% or more of the entire fibers in quantity.

The sealing elements of felt can reduce a resistance due to sliding contact with the developing roller. Especially, when surfaces of the sealing elements are coated with a lubricating agent, that effect becomes conspicuous. As the lubricating agent, it is preferable to use a lubricating agent including a fluorine oil and a fluorine-base resin. It makes a great contribution to the improved wear resistance and durability, thereby reducing noises generated when the developing roller slides on the sealing elements.

As toner, polymerized toner is often used. Polymerized toner is used to obtain high quality images because it has a uniform particle size as compared with powdered toner. Polymerized toner is easy to pass in between the sealing elements and the developing roller because of high flowability. However, toner leakage can be reliably prevented with the use of the sealing elements.

Preferably, the developing roller is made of an elastic member such as silicon rubber to reduce damage to the photosensitive member and toner. Normally, the developing roller made of a material such as silicon rubber has difficulty carrying toner on the surface, and is apt to cause toner leakage, as compared with that of a foam member. If the developing roller is made of metal, it is also apt to cause toner leakage because the surface is easily scratched.

However, toner leakage can be reliably prevented with the use of sealing elements.

The sealing element made of a fabric resists a ragged state as compared with that made of felt. It is carefree from fibers coming off of the fabric. That is, the sealing element made of a fabric has a high durability. In addition, as a fabric includes weaving seams, it has excellent toner sealability.

The weaving seams regulate a direction that toner is moved. If the weaving seams are formed so as to move toner toward a direction that toner does not leak from the developing roller, the effect of preventing toner leakage can be greatly improved.

It is preferred that the direction that toner is moved by the weaving seams of the sealing element is inclined 45° or less with respect to a direction that toner is fed by the developing roller, in allowing toner to be effectively fed.

The weaving seams are formed in combination with vertical (warp) threads and horizontal (weft) threads, where each of the vertical threads passes over two adjacent horizontal threads. The weaving seams are formed in such a manner that two adjacent vertical threads pass over one common horizontal thread, and one of the vertical threads passes over a horizontal thread following the common horizontal thread, while the other one passes under it.

By doing this, the vertical threads protrude from the surface of the sealing element in a stepped arrangement and toner is guided along the vertical threads in the stepped arrangement. When the direction to guide toner is orientated toward a developing chamber, toner passing in between the sealing element and the developing roller is returned to the developing chamber of the developing cartridge or the developing agent container, so that toner leakage can be reliably prevented.

The sealing element is cut into a rectangle to make a long side of the rectangle oriented toward the direction of the vertical threads woven into the sealing element, with the direction of the vertical threads woven into the fabric oriented to substantially the same as the direction that the developing roller conveys toner. By doing so, raveling at the seams due to sliding contact between the developing roller and the sealing element can be prevented, and as a result, toner leakage can be prevented.

When the surface of the sealing element made of a fabric is coated with the lubricating agent, the lubricating agent enters the weaving seams, which greatly contributes to the improved toner sealability.

Preferably, the sealing element is made of cashmere-base fibers of which thickness is smaller than or equal to 2.1 times as large as a mean particle diameter of toner, in allowing the toner sealability to improve. Further, it is preferable that two sealing elements, one at each end of the developing roller, are provided. However, only one sealing element may be provided.

When the sealing element is provided with a regulator such as to guide toner in a specified direction, toward the housing, the effect of preventing toner leakage can be improved.

The sealing element may be made of fibers as described above, resin or rubber which will be described later. The regulator may be a weaving seam or a recess made of resin or rubber.

It is preferable that the direction that toner is moved is inclined 45° or less with respect to the direction that the developing roller conveys toner. With this inclination, toner passing in between the sealing element and the developing roller receives a force to guide the toner, so that toner is efficiently removed from between the sealing element and the developing roller.

With the application of the above-described lubricating agent to the surface of the sealing element, the resistance due to the sliding contact between the developing roller and the sealing element can be reduced, thereby contributing to the improved wear resistance and the durability of the sealing element.

The developing roller feeds toner in a direction perpendicular to the axial direction thereof, and the sealing elements are disposed so as to make contact with the developing roller at both ends with respect to the axial direction. Each of the sealing elements has an identifier to avoid misplacement. The identifier may be formed in a notch, which can be produced in a simple process. If the sealing elements are misplaced, toner passing in between the developing roller and the sealing elements at both sides is led outside the housing. With the identifier, misplacement of the sealing elements can be omitted, so that toner leakage can be reliably prevented.

BRIEF DESCRIPTION OF THE DRAWINGS

The patent or application file contains at least one drawing executed in color. Copies of this patent or patent application publication with color drawings will be provided by the Office upon request and payment of the necessary fee.

A preferred embodiment of the invention will be described in detail with reference to the following figures wherein.

DETAILED DESCRIPTION OF PREFERRED EMBODIMENTS

Figure 1:
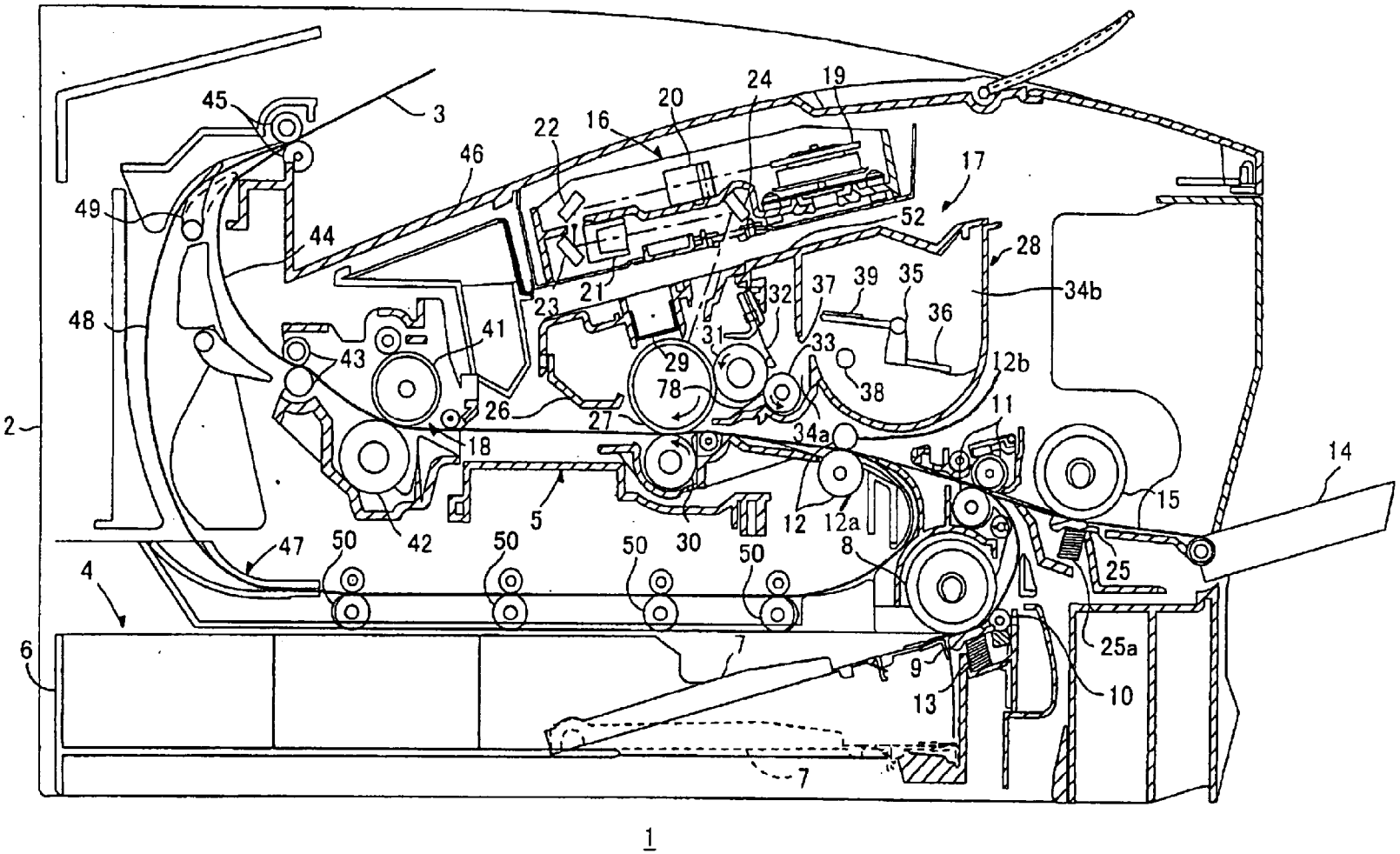
FIG. 1 is a side sectional view of the substantial parts of a laser printer according to one embodiment of the invention.

FIG. 1 is a side sectional view of the substantial parts of a laser printer 1 according to an embodiment of the invention. A sheet feed tray 6 is detachably attached to a bottom portion of a casing 2. A presser plate 7 is provided in the sheet feed tray 6 so as to support and upwardly press sheets 3 stacked in the sheet feed tray 6. A sheet feed roller 8 and a sheet feed pad 9 are provided above one end of the sheet feed tray 6, and register rollers 12 are provided downstream from the sheet feed roller 8 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closer to the sheet feed roller 8. The presser plate 7 is urged upwardly from its reverse side by a spring (not shown). When the stack of sheets 3 is increased in quantity, the presser plate 7 swings downwardly about the end of the presser plate 7 remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, print sheets 3 are fed one by one from the top.

After paper dust is removed from the sheet 3 by a paper dust removing roller 10, the sheet 3 is conveyed by conveyer rollers 11 to the resister rollers 12. The register rollers 12 are made up of two rollers, that is, a driving roller 12*a* provided for the casing 2 and a driven roller 12*b* provided for a process unit 17, which will be described later. The driving roller 12*a* and the driven roller 12*b* make a surface-to-surface contact with each other. The sheet 3 conveyed by the conveyor rollers 11 is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 stacked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 25. The sheets 3 stacked on the manual feed tray 14 are fed one by one while being pinched by the manual feed roller 15 and the separation pad 25 when the manual feed roller 15 rotates.

The casing 2 further includes a scanner unit 16, a process unit 17, and a fixing unit 18.

The scanner unit 16 is provided in an upper portion of the casing 2 and has a laser emitting portion (not shown), a rotatable polygonal mirror 19, lenses 20, 21, and reflecting mirrors 22, 23, 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and scanned at a high speed over the surface of a photosensitive drum 27, which will be described later.

Figure 2:
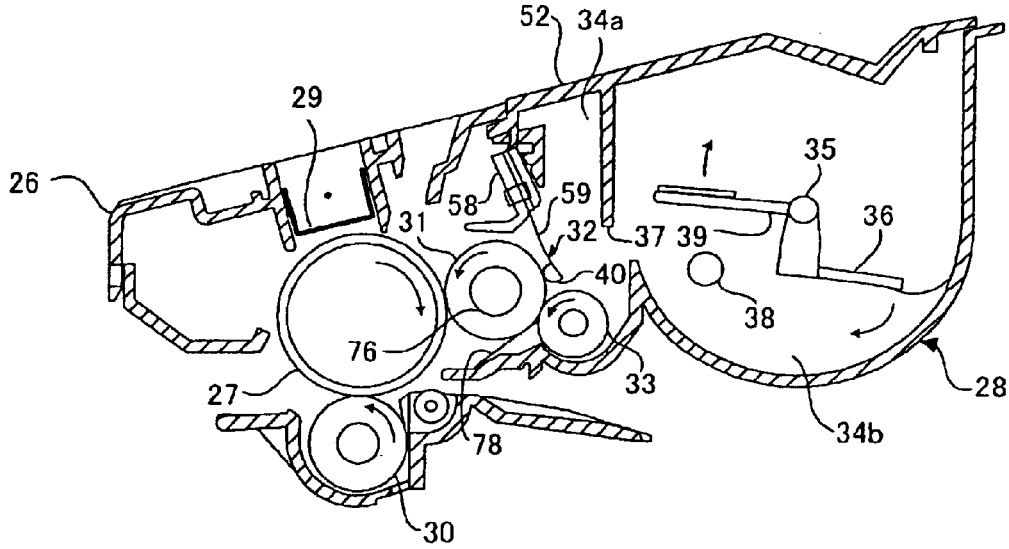
FIG. 2 is a side sectional view of the substantial parts of a process unit of the laser printer shown in FIG. 1.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, a transfer roller 30, and an electrically conductive brush 51.

The developing cartridge 28 includes a developing roller 31, a layer thickness-regulating blade 32, a supply roller 33, a developing chamber 34*a*, and a toner box 34*b*.

The toner box 34*b* contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34*b* is stirred by an agitator 36 supported by a rotating shaft 35 provided at a central portion of the toner box 34*b*, and is discharged from a toner supply port 37 opened on one side of the toner box 34*b*, toward the developing chamber 34*a*. A toner detection window 38 is provided on a side wall of the toner box 34*b*. The toner detection window 38 is wiped clean by a cleaner 39 supported by the rotating shaft 35.

A supply roller 33 is rotatably disposed in the developing chamber 34*a*. A developing roller 31 is rotatably disposed facing the supply roller 33.

The supply roller 33 is formed by covering a metallic roller shaft with an electrically conductive foam material. The developing roller 31 is formed by covering a metallic roller shaft with an electrically conductive rubber material. More specifically, the developing roller 31 is covered with an electrically conductive urethane or silicone rubber containing fine carbon particles, and coated with a urethane or silicone rubber containing fluorine. The supply roller 33 and the developing roller 31 are disposed in contact with each other so that they are press-deformed against each other to an appropriate extent. A predetermined developing bias is applied to the developing roller 31 with respect to the photosensitive drum 27.

A layer thickness-regulating blade 32 is disposed near the developing roller 31 to regulate the thickness of a toner layer formed on the surface of the developing roller 31. The layer thickness-regulating blade 32 has a metallic plate spring and a presser portion 40, which is disposed on a distal end of the plate spring and formed from an electrically insulative silicone rubber into a semicircular shape in section. The plate spring is supported, at its end opposite to its distal end, by a developing cartridge 28 so as to be close to the developing roller 31. The presser portion 40 is pressed against the developing roller 31 by an elastic force of the plate spring.

Toner discharged by the agitator 36 from the toner supply port 37 to the developing chamber 34*a* is supplied to the developing roller 31 when the supply roller 33 rotates. Toner is positively charged between the supply roller 33 and the developing roller 31 due to friction. Toner supplied to the developing roller 31 passes between the presser portion 40 and the developing roller 31 and is sufficiently positively charged therebetween due to friction. After passing between the presser portion 40 and the developing roller 31, toner is formed into a thin layer of a predetermined thickness on the developing roller 31.

The photosensitive drum 27 is rotatably disposed adjacent to a drum cartridge 26 so as to be in contact with the developing roller 31. The photosensitive drum 27 is formed by coating a grounded cylindrical aluminum drum with a positively charged photosensitive layer made of polycarbonate.

The scorotron charger 29 is disposed at a predetermined interval upward from the photosensitive drum 27. The scorotron charger 29 is a charger that produces corona discharge from a tungsten wire and positively charges the surface of the photosensitive drum 27 uniformly.

The transfer roller 30 is disposed below the photosensitive drum 27 and is rotatably supported by the drum cartridge 26 so as to face the photosensitive drum 27. The transfer roller 30 is formed by covering a metallic roller shaft with an electrically conductive rubber material. A power source (not shown) is connected to the roller shaft, and a predetermined transfer bias is applied to the roller shaft when toner on the photosensitive drum 27 is transferred to the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to heat, while the sheet 3 is passing between the heat roller 41 and the pressure roller 42. After the fixation is completed, the sheet 3 is conveyed downstream by the conveying rollers 43.

An ejecting path 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting path 44 to eject the sheet 3 to the output tray 46.

The laser printer 1 is provided with a reverse conveying unit 47 that allows image forming on the both sides of the sheet 3. The reverse conveying unit 47 includes ejecting rollers 45, a reverse conveying path 48, a flapper 49, and a plurality of pairs of reverse conveying rollers 50.

A pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a horizontal direction. A pair of reverse conveying rollers 50 on the most upstream side are located near the lower end of the reverse conveying path 48. A pair of reverse conveying rollers 50 on the most downstream side are located below the register rollers 12.

The operation of the reverse conveying unit 47 when an image is formed on the both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotate in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the register rollers 12. The sheet 3 is then conveyed to the process unit 17 with its printed side facing down. As a result, an image is printed on both sides of the sheet 3.

The image forming operation will now be described. The surface of the photosensitive drum 27 is uniformly positively charged by the scorotron charger 29. The surface potential of the photosensitive drum 27 is approximately 900 V. When the surface of the photosensitive drum 27 is irradiated with a laser beam emitted from the scanner unit 16, electric charge is removed from a portion exposed to the laser beam, and the surface potential of the exposed portion becomes approximately 200V. In this way, the surface of the photosensitive drum 27 is divided into a high-potential portion (unexposed portion) and a low-potential portion (exposed portion), and thereby an electrostatic latent image is formed.

The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, an electric latent image formed on the photosensitive drum 27 is visualized.

The developing roller 31 reclaims the toner remaining on the surface of the photosensitive drum 27. The remaining toner is the toner that has been supplied to the photosensitive drum 27 but not transferred by the transfer roller 30 from the photosensitive drum 27 to the sheet 3. The remaining toner adheres to the developing roller 31 by a Coulomb force generated due to a potential difference between the photosensitive drum 27 and the developing roller 31, and is reclaimed into the developing cartridge 28. With this method, a scraper that scrapes the remaining toner from the photosensitive drum 27 and a storage place for the scraped toner are not required. Thus, a laser printer can be simplified in structure and made compact, and the manufacturing cost thereof can be reduced.

While the sheet 3 is passing between the photosensitive drum 27 and the transfer roller 30, the toner forming a visualized image on the photosensitive drum 27 is transferred to the sheet 3 by a Coulomb force generated due to a potential difference between the potential of the sheet 3 and the surface potential of the photosensitive drum 27.

The sheet 3 is conveyed to the fixing unit 18, and as described above, the toner on the sheet 3 melts and becomes fixed onto the sheet 3 due to heat. After passing along the ejecting path 44, the sheet 3 where the toner is fixed is ejected to the output tray 46.

Side seals 51 are disposed at both ends of the inside of the developing cartridge 28 with respect to an axial direction of the developing roller 31 when mounted in position in the developing cartridge 28 in order to prevent toner carried on the developing roller 31 from leaking from both ends of the developing roller 31. Referring to FIGS. 4A to 6, the sealing structure at each end of the inside of the developing cartridge 28 with respect to the axial direction of the developing roller 31 will be described. The figures show structural elements at only one end of the inside of the developing cartridge 28, and the following descriptions are made based on one end of the inside of the developing cartridge 28. The structural elements at the one end are identical to those at the other end.

As shown in FIG. 4, a housing 52 constituting the developing cartridge 28 is open at a front side. A side wall 53 of the housing 52 is provided with a support hole 54 for which the developing roller 31 is mounted in the housing 52. Adjacent to the side wall 53, the side seal 51, an upper side seal 55 (FIG. 5), a blade side seal 56 (FIG. 5), and a lower side seal 57 are provided, which reliably prevent toner from leaking from each end of the developing roller 31 when mounted in the developing cartridge 28 in position. The support hole 54 has an opening 75 at a front side thereof and is formed so as to receive the roller shaft 76 of the developing roller 31 along the opening 75.

Figure 5:
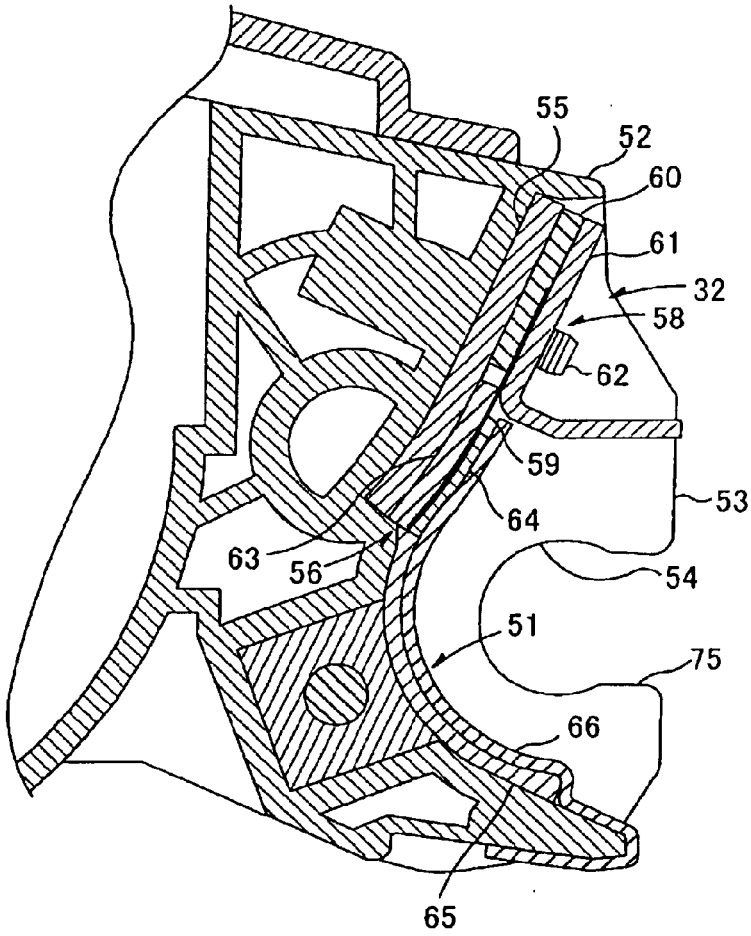
FIG. 5 is a side sectional view of the substantial parts of the sealing structure at the end of the developing cartridge when the developing roller is not mounted.

The upper side seal 55 is made of a spongy material (e.g. urethane) formed in a substantially rectangular shape having a fixed thickness. As shown in FIG. 5, the upper side seal 55 is disposed facing a leaf spring member 59 of the layer thickness-regulating blade 32 at an upper portion of the end of the housing 52, and affixed to the housing 52 with double-faced adhesive tape. Provision of the upper side seal 55 can improve the adhesion of the blade side seal 56.

The blade side seal 56 is provided facing the upper side seal 55 at an end of the leaf spring member 59 of the layer thickness-regulating blade 32. The blade side seal 56 is made up of a back blade seal 63 provided on a rear surface of the leaf spring member 59 and a front blade seal 64 provided on a front surface of the leaf spring member 59.

A support member 58 of the layer thickness-regulating blade 32 is comprised of a back support member 60 formed in a plate extending along the axial direction of the developing roller 31, and a front support member 61, which is an L-shape in cross section and is in face-to-face relation with the back support member 60. With the leaf spring member 59 sandwiched between the back support member 60 and the front support member 61, the support member 58 is secured to an upper part of the housing 52 using two screws 62.

The back blade seal 63 is made of a sponge material (e.g. urethane) formed in a substantially rectangular shape having a fixed thickness. The back blade seal 63 is affixed to the rear surface of the leaf spring member 59 facing the upper side seal 55, with double-faced adhesive tape. The back blade seal 63 and the upper side seal 55 are made of sponge material and make contact with each other, thereby preventing the toner from leaking from the upper part of each end of developing roller 31 when mounted in position.

The front blade seal 64 is made of a sponge material (e.g. urethane) formed in a substantially rectangular shape having a fixed thickness, and is affixed to the leaf spring member 59 facing the back blade seal 63 with double-faced adhesive tape. A sealing element 66A, 66B is placed over the front blade seal 64. When the front blade seal 64 and the sealing element 66A, 66B are layered, they are compressed to an extent that a total thickness of them becomes thicker than the thickness of the presser portion 40 of the layer thickness-regulating blade 32. With this structure, toner can be prevented from laterally leaking from between the presser portion 40 and the developing roller 31, even if the presser portion 40 is worn by friction with the developing roller 31.

Figure 4A:
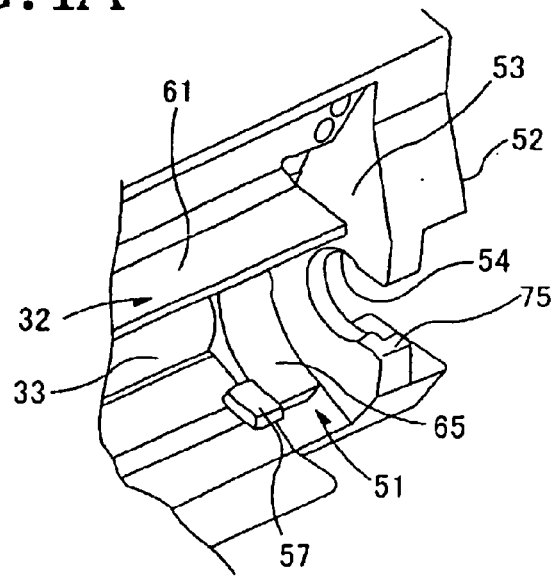
FIG. 4A is a perspective view of the substantial parts of a sealing structure at an end of the developing cartridge with respect to an axial direction of the developing roller to be mounted in the developing cartridge, where a sponge seal of a side seal is affixed.
Figure 4B:
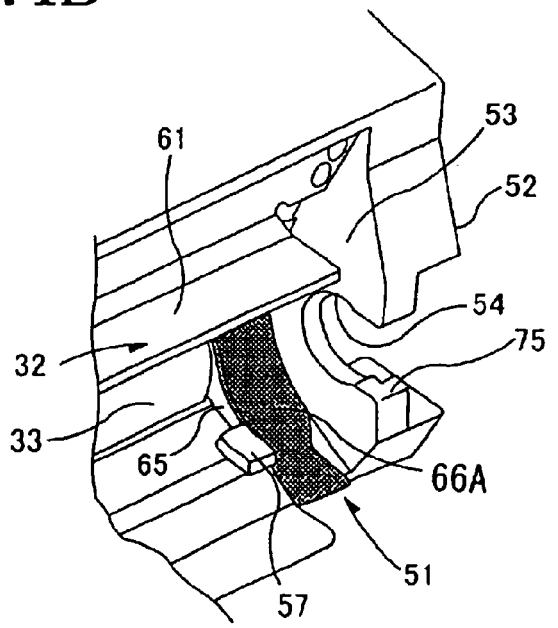
FIG. 4B is a perspective view of the substantial parts of the sealing structure at the end of the developing cartridge, where a felt sealing element is overlaid on the sponge seal.
Figure 4C:
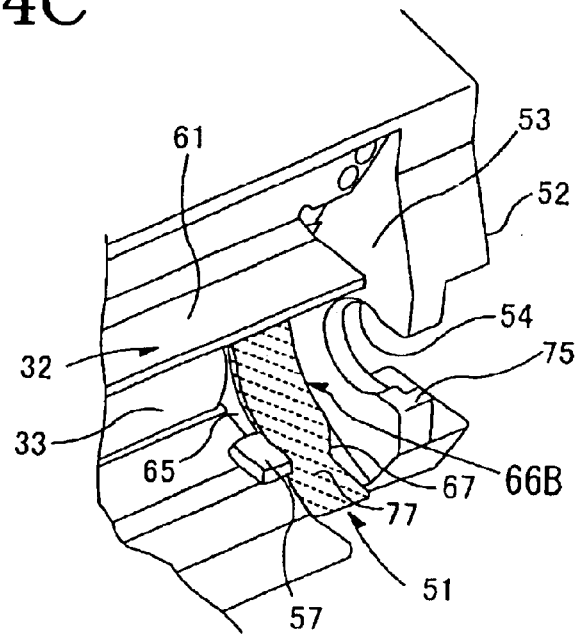
FIG. 4C is a perspective view of the substantial parts of the sealing structure at the end of the developing cartridge, where a sealing element is overlaid on the sponge seal at the end of the developing cartridge.

As shown in FIGS. 4A–4C, the lower side seal 57 is made of a sponge material (e.g. urethane) formed in a substantially rectangular shape having a fixed thickness, disposed adjacent to an inner side of the side seal 51, and affixed to a lower part of the housing 52 with double-faced adhesive tape.

Figure 3:
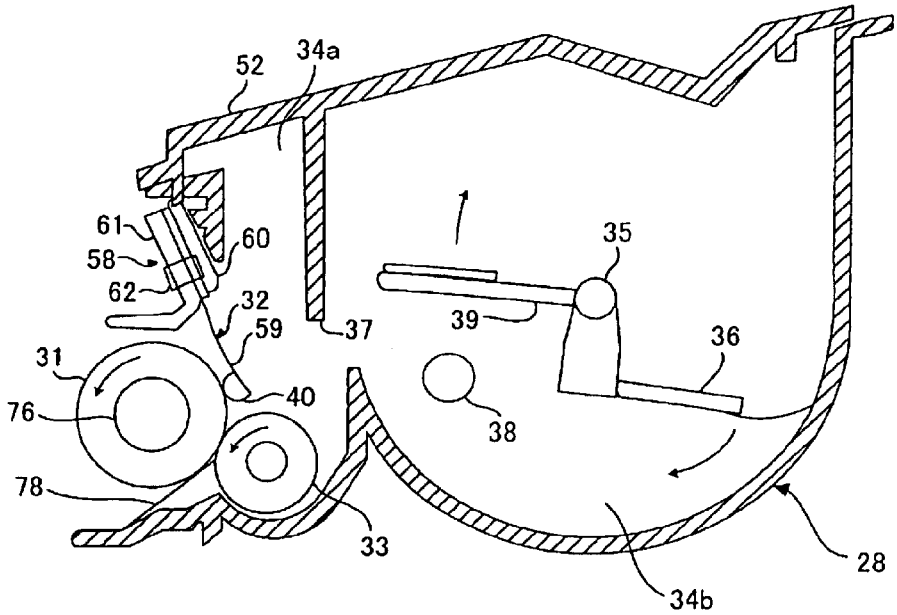
FIG. 3 is a side sectional view of the substantial parts of a developing cartridge in the process unit shown in FIG. 2.

Provision of the lower side seal 57 can prevent the toner from leaking from a boundary between the side seal 51 and a lower film 78 (FIG. 3).

The side seal 51 is provided adjacent to the side wall 53 of the housing 52 so as to make sliding contact with a circumferential surface of the developing roller 31. The side seal 51 is comprised of a sponge seal 65, and a sealing element 66A or 66B which is overlaid on the sponge seal 65.

The sponge seal 65, providing an urging force, is made of a spongy material such as urethane. More specifically, it is made of urethane having a comparatively high rigidity (trademark: Poron, manufactured by Rogers Inoac Corporation), and formed in a substantially rectangular shape having a certain thickness to generate a fixed pressing force when compressed by the developing roller 31 mounted in position.

Figure 6:
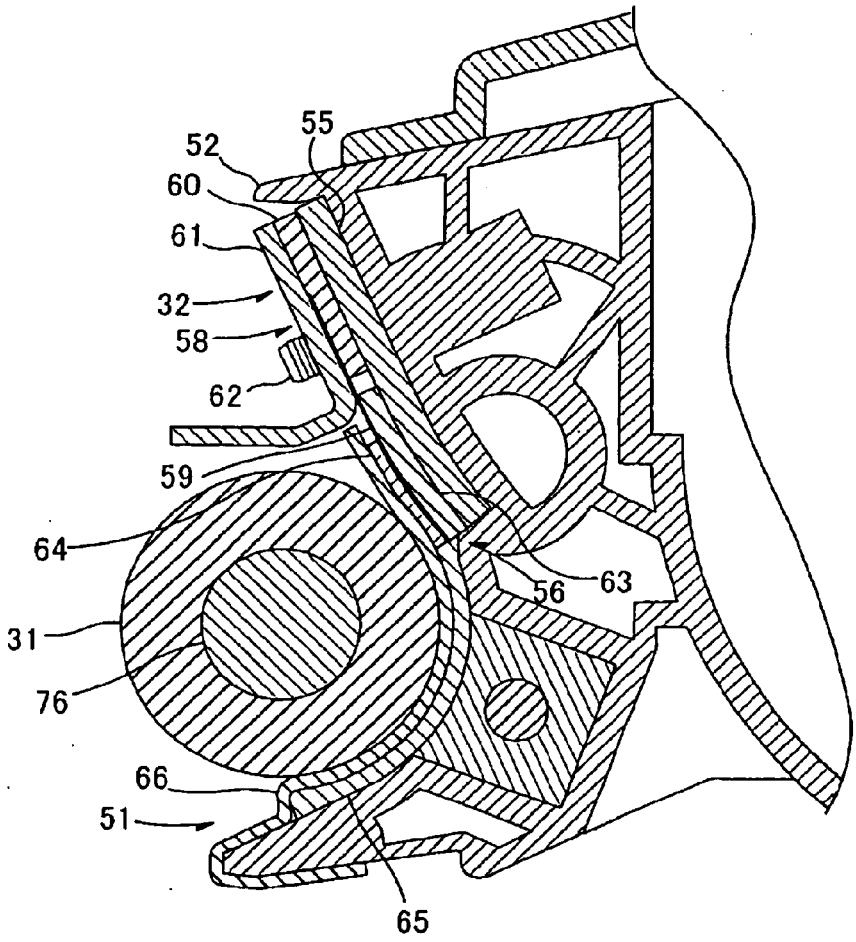
FIG. 6 is a side sectional view of the substantial parts of the sealing structure at the end of the developing cartridge when the developing roller is mounted.

The sponge seal 65 is affixed to the housing with double-faced adhesive tape with the following state: an upper end of the sponge seal 65 is pressed against the back blade seal 63 and the front blade seal 64 as shown in FIG. 6; and a lower end of the sponge seal 65 and the lower side seal 57 slightly overlap each other in the width direction of the housing 52 as shown in FIG. 4A.

The sponge seal 65, the back blade seal 63, and the front blade seal 64, are all made of sponge materials. With this structure, when the upper end of the sponge seal 65 is pressed against the back blade seal 63 and the front blade seal 64, sponge materials make contact with each other to reliably prevent toner leakage in the boundary between the sponge seal 65, the back blade seal 63, and the front blade seal 64.

By making the lower end of the sponge seal 65 and the lower side seal 57 overlap each other, the sponge materials make contact with each other, thereby preventing toner leakage in the boundary between the sponge seal 65 and the lower side seal 57.

The sealing element 66A, 66B is formed into a flat film having flexibility, and made of a felt of polyester-base fibers or a textile of cashmere-base fibers. As shown in FIGS. 4B, 4C, the sealing element 66A, 66B is overlaid on the sponge seal 65, adjacent to the side wall 53 at an end of the housing 52. As shown in FIGS. 5, 6, the sealing element 66A, 66B covers the front blade seal 64 at an upper end thereof, covers the sponge seal 65 at a lower end thereof, further extends downwardly from the sponge seal 65, and rolls up the lower end of the housing 52. The sealing element 66A, 66B is affixed with double-faced adhesive tape.

As the sealing element 66A, 66B covers the front blade seal 64 at the upper end, toner can be reliably prevented from laterally leaking from the presser portion 40 of the layer thickness-regulating blade 32. As the sealing element 66A, 66B moves in accordance with the leaf spring member 59 of the layer thickness-regulating blade 32, the movement of the leaf spring member 59 is not limited, and the presser portion 40 is normally pressed against the developing roller 31 under a preferable condition. Thus, the layer of toner formed on the developing roller 31 becomes uniform.

The front blade seal 64 interposed between the sealing element 66A, 66B and the leaf spring member 59 can be adequately compressed because it is made of sponge material. The front blade seal 64 can effectively absorb a reactive force of a pressing force between the sealing element 66A, 66B and the developing roller 31, thereby reliably obtaining the toner sealability between the sealing element 66A, 66B and the developing roller 31.

The end of the housing 52 where the side seal 51 is provided is formed in a curved shape along the circumferential surface of the developing roller 31 so as to bring the side seal 51 into contact with the developing roller 31. The sponge seal 65 and the sealing element 66A, 66B are layered along the curved shape, thus, the sealing element 66A, 66B becomes curved along the circumferential surface of the developing roller 31.

The developing roller 31 is rotatably mounted in the housing 52 by inserting the roller shaft 76 of the developing roller 31 along and into the support hole 54 from the front face where the housing 52 is open, as shown in FIG. 4B. Thus, the developing roller 31 can rotate in a state that the circumferential surface of the developing roller 31 makes sliding contact with the sealing element 66A, 66B at the end as shown in FIG. 6.

While the developing roller 31 rotates, toner does not leak from between the developing roller 31 and the sealing element 66A, 66B at the end of the developing roller 31, thereby ensuring sufficient toner sealability.

The lower film 78 is made of a polyethylene terephthalate (PET) sheet or an urethane rubber film, and affixed, with double-faced adhesive tape, entirely to a top face of the lower part of the housing 52, as shown in FIGS. 2 and 3. The lower film 78 prevents toner from leaking from the lower part of the housing 52.

The following are descriptions about actions and effects when a polyester-base felt is used for the sealing element 66A of the side seal 51.

It is preferable that the polyester-base felt is made of 100% polyester fibers. However, the polyester-base felt may be a blend of other fibers as long as polyester is mainly used.

If a Teflon® felt is used for a sealing element, it has an effect of reducing torque of the developing roller 31 because the Teflon® fiber is thick as compared with polyester fiber. However, the Teflon® felt is liable to sustain damage due to friction with the developing roller 31.

Because the Teflon® felt is weak and tends to be torn, toner can pass in between the developing roller 31 and the sealing element, and consequently, toner leakage is prone to occur. If the developing roller 31 is rotated at a high speed during continuous use of the laser printer 1, a problem that the Teflon® felt tends to be torn comes to the surface conspicuously.

In this embodiment, as the polyester-base felt is used for the sealing element 66A, improvements in wear resistance and durability can be obtained as compared with the Teflon® felt. Even if the developing roller 31 is rotated at a high speed during continuous use of the laser printer 1, preferable toner sealability can be ensured.

The polyester-base felt of the embodiment is made up of at least two different kinds of fibers in thickness, a fine fiber and a thick fiber, and preferably, the fine fiber constitutes 30% or more of the total fibers. It is further preferable that the fine fiber constitutes 50% or more of the total fibers. It is desirable that the fine fiber has a thickness smaller than or equal to 2.1 times as large as the mean diameter of toner particle and is made of 100% polyester.

In this way, as the fine fiber and the thick fiber are tangled into the polyester-base felt, the fine fiber can prevent toner leakage and damage such as wear during continuous use, and the thick fiber can prevent reduction of the strength due to abrasion caused by the developing roller 31 during continuous use.

When the fine fiber makes up 30% or more of the total fibers, toner leakage and damage such as wear can be reliably prevented.

When the thickness of the fine fiber is smaller than or equal to 2.1 times of the mean diameter of toner particle, the flow of toner can be effectively inhibited with the fine fiber structure, so that toner leakage can be reliably prevented from occurring. When the fine fiber is made of 100% polyester, the wear resistance and the durability can be improved. With the use of the sealing element 66A satisfying the above requirements, preferable toner sealability can be obtained.

More specifically, the polyester-base felt in the laser printer 1 includes fine fiber of 100% polyester having a thickness of approximately 12.5 $\mu$m, and thick fiber of 100% polyester having a thickness of approximately 25–26 $\mu$m, fifty-fifty. With this combination, toner of which the mean particle size is up to 6 $\mu$m can be sealed.

In the embodiment, the sealing element 66A is made of the above-described polyester-base felt.

If a sealing element is made of a foam member such as a sponge material, it gets damaged and torn due to abrasion caused by the developing roller 31. If a sealing element is made of an elastic member such as rubber, frictional resistance between the developing roller 31 and the sealing element becomes great, great loads are imposed on the developing roller 31 and the sealing element, and torque of the developing roller 31 needs increasing. If toner flows between the developing roller 31 and the sealing element, the toner scratches the surface of the sealing element from which toner is prone to leak.

However, as the sealing element 66A is a felt, the frictional resistance between the developing roller 31 and the sealing element 66A can be decreased, and toner leakage can be prevented.

A textile fabric 67 made of cashmere-base fibers can be used for the sealing element 66B of the side seal 51. The fiber thickness is smaller than or equal to 2.1 times of the mean diameter of toner particle, more specifically, 15±5 $\mu$m is preferable. The shape of the fibers in cross section is preferably circular or flat. One vertical (warp) thread 68 and one horizontal (weft) thread 69 to be woven into the textile fabric 67 are formed by twisting together multiple fibers satisfying the above requirements.

Figure 9:
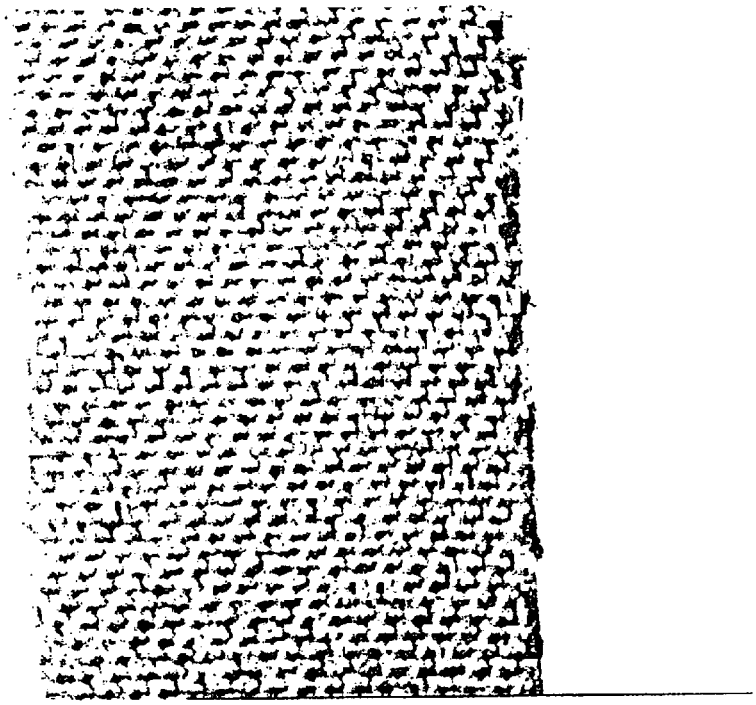
FIG. 9 is a microscope photograph of a textile fabric for the sealing element of FIG. 4C.
Figure 10:
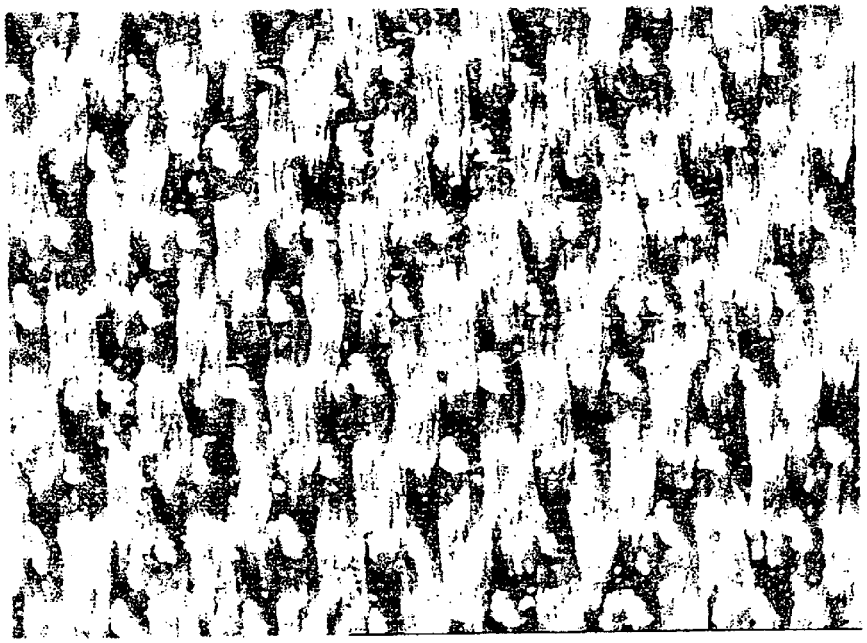
FIG. 10 is a microscope photograph of a magnified view of weaving seams in the textile fabric of FIG. 9.
Figure 11:
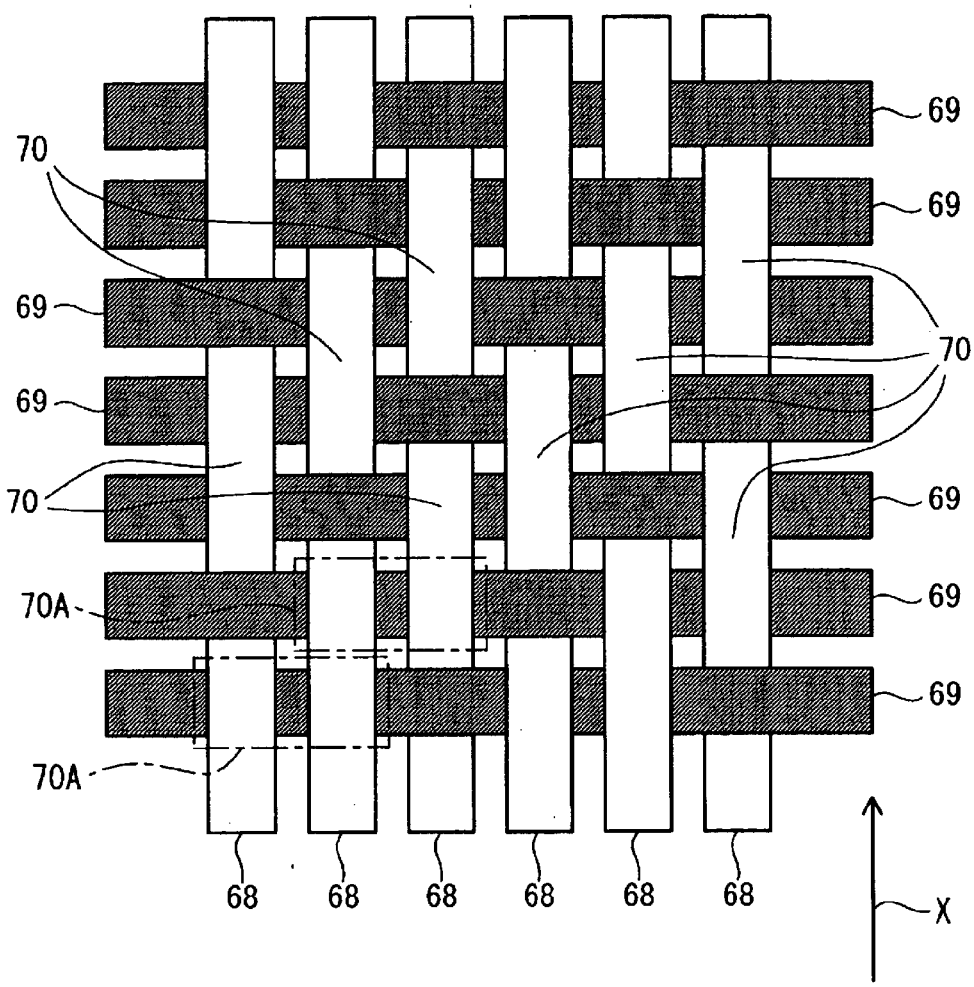
FIG. 11 is a schematic diagram of weaving seams of the sealing element shown in FIG. 4C.

FIGS. 9 and 10 are microscope photographs of the textile fabric 67 where the developing roller 31 slides thereon. FIG. 11 is a schematic diagram of the textile fabric 67.

The textile fabric 67 is twilled in such a manner to diagonally form weaving seams in which vertical threads 68 and horizontal threads 69 are crossed over each other. On the surface of the textile fabric 67 where the developing roller 31 slides, each vertical thread 68 passes over two horizontal threads 69 and then passes under one horizontal thread 69. Each horizontal thread 69 passes over one vertical thread 68 and then passes under two vertical threads 68.

After two adjacent vertical threads 68 pass over one common horizontal thread 69, one of the two adjacent vertical threads 68 passes over a next adjacent horizontal thread 69 while the other one passes under the next adjacent horizontal thread 69.

Each vertical thread 68 includes a portion 70 where the vertical thread 68 lies over the two horizontal threads 69 in FIG. 1. The portion 70 protrudes from the surface of the textile fabric 67 where the developing roller 31 slides, in FIG. 9. The portion 70 is hereinafter called a front side protruding portion 70. The front side protruding portions 70 of the vertical threads 68 are arranged aslant, uniformly and continuously (sloped gradually upward from the left in FIGS. 9 to 11). As the front side protruding portions 70 are arranged in such a way, protruding weaving seams 77 (FIG. 4C) are formed aslant on the surface of the textile fabric 67.

The protruding weaving seams 77 are formed diagonally so as to lean toward the developing chamber 34*a* with respect to the rotational direction X, that is, toward the center of the developing roller 31 in its axial direction, when the sealing element 66B, cut from the textile fabric 67 to an appropriate size, is affixed on the sponge seal 65. The protruding weaving seams 77 are formed diagonally so as to incline 45° or less with respect to the rotational direction X.

When the sealing element 66B is affixed to the sponge seal 65, the protruding weaving seams 77 are placed so as to lean toward the developing chamber 34*a* with respect to the rotational direction X. If toner is conveyed from the center of the developing roller 31 to the sealing element 66B, it touches the front side protruding portions 70 of the vertical threads 68, and receives a force causing toner to move toward the developing chamber 34*a*. That is, toner is inhibited from moving toward the end of the developing roller 31.

As the developing roller 31 rotates, toner moves along the protruding weaving seams 77 toward the center of the developing roller 31, that is, toward the developing chamber 34*a*, and returns to the developing chamber 34*a*.

Therefore, toner leakage can be reliably prevented, and the toner sealability can be ensured even if the developing roller 31 is rotated at a high speed.

The sealing element 66B is bonded on the sponge seal 65 such that the protruding weaving seams 77 of the textile fabric 67 incline 45° or less with respect to the rotational direction X. Thus, toner on the sealing element 66B is returned to the developing chamber 34*a* reliably and promptly by the protruding weaving seams 77.

Figure 15A:
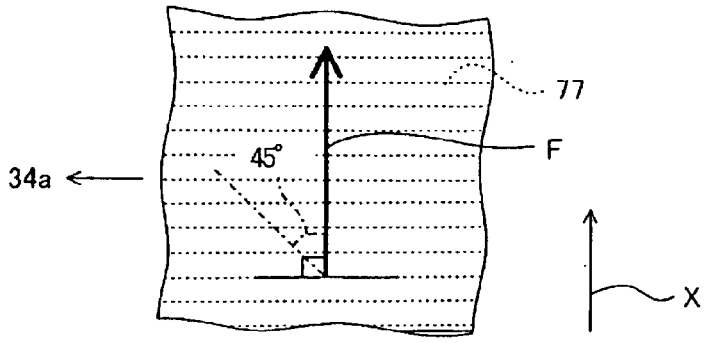
FIG. 15A is a partial plan view of the sealing element showing that protruding weaving seams incline 90° with respect to a rotational direction of the developing roller.

As shown in FIG. 15A, when the protruding weaving seams 77 incline 90° with respect to the rotational direction X, the protruding weaving seams 77 absorb a force F acting on toner passing in the sealing element 66B by the rotation of the developing roller 31. Thus, toner passing in the sealing element 66B will not head for the developing chamber 34*a*.

Figure 15B:
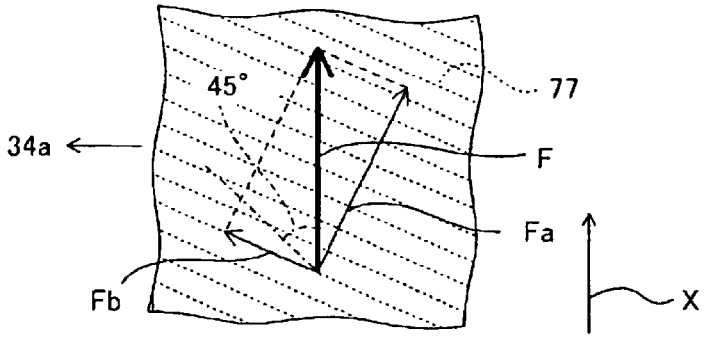
FIG. 15B is a partial plan view of the sealing element showing that the protruding weaving seams incline less than 90° but greater than 45° with respect to the rotational direction of the developing roller.

As shown in FIG. 15B, when the protruding weaving seams 77 incline less than 90° but greater than 45° with respect to the rotational direction X, the force F acting on toner passing in the sealing element 66B by the rotation of the developing roller 31 is easily absorbed at the protruding weaving seams 77. The force F includes a component Fb parallel to the protruding weaving seams 77 and a component Fa perpendicular to the protruding weaving seams 77. In FIG. 15B, because the component Fa is stronger than the component Fb, it is difficult for toner to head for the component Fb. Thus, it is difficult for toner passing in the sealing element 66B to head for the developing chamber 34*a*.

Figure 15C:
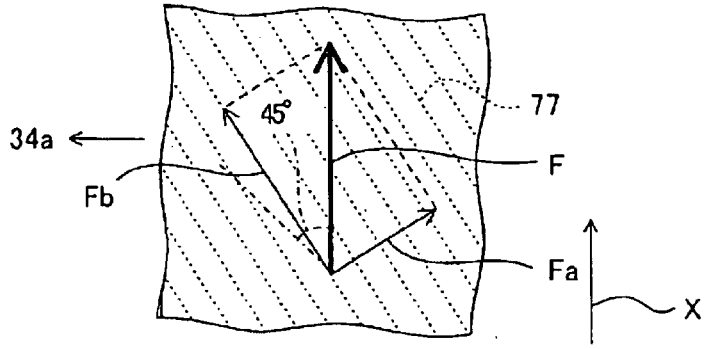
FIG. 15C is a partial plan view of the sealing element showing that the protruding weaving seams incline 45° or less with respect to the rotational direction of the developing roller.

As shown in FIG. 15C, when the protruding weaving seams 77 incline 45° or less with respect to the rotational direction X, the force F acting on toner passing in the sealing element 66B by the rotation of the developing roller 31 is difficult to be absorbed at the protruding weaving seams 77. Therefore, toner passing in the sealing element 66B is apt to head for the developing chamber 34*a*. In FIG. 15C, because the component Fb is stronger than the component Fa, toner is apt to head for the component Fb. Thus, toner leakage can be reliably prevented and the sufficient toner sealability can be ensured even if the developing roller 31 is rotated at a high speed.

The textile fabric 67 is woven with the vertical threads 68 and the horizontal threads 69. In the textile fabric 67, each of the vertical threads 68 passes over two adjacent horizontal threads 69 and then under the following adjacent horizontal thread 69. The front side protruding portions 70 of the vertical threads 68, which will protrude from the surface of the textile fabric 67 toward the developing roller 31, are made while the vertical threads 68 and the horizontal threads 69 are woven.

By weaving the textile fabric 67 in this way, the front side protruding portions 70 of the vertical threads 68 become nearly equal in length as shown in FIG. 11, and the adjacent front side protruding portions 70 are placed in a stepped arrangement.

Thus, although the structure of the textile fabric 67 is simple where the vertical threads 68 and the horizontal threads 69 are just crossed over each other, the front side protruding portions 70 of the vertical threads 68 are uniformly placed in a stepped arrangement. With the stepped arrangement of the adjacent front side protruding portions 70, toner leakage can be reliably prevented.

Two adjacent vertical threads 68 of the textile fabric 67 pass over one common horizontal thread 69 and one of the two vertical threads 68 passes over the following adjacent horizontal thread 68 and the other one passes under it.

As the textile fabric 67 is woven such that the adjacent front side protruding portions 70 of the vertical threads 68 are placed in a stepped arrangement, the protruding weaving seams 77 made up of the front side protruding portion 70 are formed diagonally as much as the structure of the textile fabric 67 is simple. Thus, according to the sealing element 66B made of the textile fabric 67, toner leakage can be reliably prevented.

By weaving the threads as above, each of the horizontal threads 69 includes a portion 70A where two adjacent front side protruding portions 70 are partially overlaid.

As the textile fabric 67 includes the portion 70A, toner can be reliably prevented from leaking from a gap between the adjacent front side protruding portions 70. Thus, the toner sealability can be obtained more reliably.

The sealing element 66B is disposed such that the direction of the vertical threads 68 woven into the textile fabric 67 and the rotational direction X are the same.

The sealing element 66B might be disposed such that the direction of the vertical threads 68 with the front side protruding portions 70 woven into the textile fabric 67 is different from the rotational direction X. In this case, as the laser printer 1 is used for the long term, the vertical threads 68 become liable to ravel from the textile fabric 67 by friction between the developing roller 31 and the sealing element 66B, resulting in deterioration of the toner sealability. In particular, when the developing roller 31 is continuously rotated, the toner sealability will be deteriorated at an earlier time.

However, in this embodiment, the sealing element 66B is disposed such that the direction of the vertical threads 68 woven into the textile fabric 67 is the same as the rotational direction X. Even if the laser printer 1 is used for the long term, the vertical threads 68 resist raveling from the textile fabric 67 due to friction between the developing roller 31 and the sealing element 66B. Accordingly, desirable toner sealability can be maintained for the long term.

The sealing element 66B is made by cutting the textile fabric 67 along the direction of the vertical threads 68 woven into the textile fabric 67 so that the long side of the sealing element 66B is made in the direction. By cutting this way, when the sealing element 66B is affixed to the sponge seal 65, the long side edge of the sealing element 66B can extend in the same direction as the rotational direction X. The direction of the vertical threads 68 woven into the textile fabric 67 is the same direction as the long side of the sealing element 66B. That is, the direction of the vertical threads 68 woven into the textile fabric 67 is the same direction as the rotational direction X of the developing roller 31.

If the direction of the vertical threads 68 woven into the textile fabric 67 is different from the direction of the long side of the sealing element 66B, for an extended use of the laser printer 1, the vertical threads 68 ravel from the long side edge by friction between the developing roller 31 and the sealing element 66B, leading to a problem that the toner sealability is deteriorated at an earlier time.

In this embodiment, the direction of the vertical threads 68 woven into the textile fabric 67 is the same direction as the long side of the sealing element 66B. In this case, even if the laser printer 1 is used for the long term, the sealing element 66B resists a ragged state due to friction between the developing roller 31 and the sealing element 66B. Accordingly, the desirable toner sealability can be maintained for the long term.

As described above, when the cashmere-base textile fabric 67 is used for the sealing element 66B, it resists damage such as wear. In addition, because the fabric 67 is woven so as to produce the protruding weaving seams 77, projections and depressions are formed on the surface of the sealing element 66B, thereby enabling the toner sealability between the developing roller 31 and the sealing element 66B to be maintained. Further, the sealing element 66B resists raveling resulting from friction between the developing roller 31 and the sealing element 66B, so that the preferable toner sealability can be maintained for an extended use of the laser printer 1. The toner sealability can be also obtained when the developing roller 31 is rotated at a high speed.

Especially, the sealing element 66B made of cashmere-base textile fabric 67 is excellent in resistance to abrasion and durability, as compared with the Teflon® felt.

According to the above structure, weaving seams are produced so as to cause toner passing in the sealing element 66B to move toward the developing chamber 34*a*, thereby producing a great effect of preventing toner leakage.

In this embodiment, the sealing element 66B is used to prevent toner from leaking from the end of the developing roller 31. However, the sealing element 66B may be applied to a rotated element having a bearing, such as the supply roller 33 and the agitator 36, in addition to the developing roller 31.

A lubricating agent is applied to the surface of the sealing element 66A, 66B where the developing roller 31 slides. While the developing roller 31 rotates, the lubricating agent works between the developing roller 31 and the sealing element 66A, 66B, to reduce the frictional resistance between the developing roller 31 and the sealing element 66A, 66B. Thus, the application of the lubricating agent can reduce torque of the developing roller 31, and improve the wear resistance and the durability. Further, the application of the lubricating agent can prevent noises due to friction between the developing roller 31 and the sealing element 66A, 66B from generating.

More specifically, the surface of the sealing element 66A, 66B is coated with a fluorine-base lubricating agent in which a fluorine oil and fluorine-base resin are dissolved into a volatile solvent.

When the fluorine-base lubricating agent is applied to the surface of the sealing element 66A, 66B, the fluorine oil and the fluorine-base resin lower the friction. Thereby, the frictional resistance between the developing roller 31 and the sealing element 66A, 66B is further decreased, and the wear resistance and the durability are further improved. In addition, the noises at the sliding contact between the developing roller 31 and the sealing element 66A, 66B are also prevented from generating.

The sealing element 66B is made of the cashmere-base textile fabric 67 where the threads are arranged orderly as compared with a nonwoven cloth, and thus is inferior in performance of absorbing toner to some degree. However, the application of fluorine-base lubricating agent to the sealing element 66B can prevent the reduction of the toner absorbing performance. Further, the fluorine-base lubricating agent is impregnated into the woven threads, thereby improving the toner sealability between the developing roller 31 and the sealing element 66B. Even if the developing roller 31 slides on the sealing element 66B where the projections and depression of the woven threads are formed, the fluorine-base lubricating agent smoothes the sliding contact between the developing roller 31 and the sealing element 66B, leading to the reduction of torque of the developing roller 31.

The method to apply the fluorine-base lubricating agent to the sealing element 66A, 66B is not particularly limited. For example, the lubricating agent may be applied with a brush to the surface of the long length of the textile fabric from which the sealing element 66A, 66B is to be cut to a defined size. The amount of the application of the fluorine-base lubricating agent can be changed as needed. For example, approximately 25±5 g of the lubricating agent is used for 100 sealing elements 66A, 66B. The lubricating agent above is detailed in U.S. patent application Ser. No. 09/641,919, the disclosure of which is incorporated by reference in its entity.

As the fluorine-base lubricating agent, a fluorine-base lubricating agent manufactured by Kanto Kasei Co., Ltd. and known under the trademark of Hanarl FL-Z75 is used in this embodiment. Hanarl FL-Z75 contains 80–90 wt % hydrofluorocarbon, as a volatile solvent, and 10–20 wt % polytetrafluoroethylene (PTFE) and other components, as a fluorine oil and a fluorine-base resin.

Another lubricating agent under the trademark of Hanarl FL-955 manufactured by Kanto Kasei Co., Ltd. may be used. Hanarl FL-955 contains 85–95 wt % perfluoroalkane, as a volatile solvent, and 5–15 wt % polytetrafluoroethylene (PTFE) and other components, as a fluorine oil and a fluorine-base resin.

In the laser printer 1 according to the embodiment, a polymerized toner with excellent fluidity is used. The polymerized toner is easy to pass in between the developing roller 31 and the side seal 51 when the developing roller 31 rotates because of its excellent fluidity.

In this embodiment, the sealing element 66A, 66B for the side seal 51 is felt made of polyester-base fibers or the textile fabric 67 where the protruding weaving seams 77 are formed in a stepped arrangement, as described above. Toner passing in between the developing roller 31 and the side seal 51 is reliably absorbed by the sealing element 66A, 66B or moved from the sealing element 66B toward the developing chamber 34*a*. Thus, toner can be reliably prevented from leaking from the developing cartridge 28.

In the laser printer 1 according to the embodiment, an impression developing method which uses a nonmagnetic single-component toner to make contact with the developing roller 31 and the photosensitive drum 27, is adopted. The developing roller 31 is made of an elastic member so as to obtain high quality images by reducing damage to toner and the photosensitive drum 27.

The developing roller 31 made of the elastic member is apt to cause toner leakage, as compared with that made of a foam material. If the developing roller 31 is made of metal, it is also apt to cause toner leakage because the surface becomes easily scratched. These problems appear obviously as the use of the laser printer 1 prolongs.

In the laser printer 1, the sealing element 66A, 66B of the side seal 51 is a felt made of polyester-base fibers or the textile fabric 67 made of cashmere-base fibers, as described above. Thus, even if the laser printer 1 is used over a prolonged period, toner can be reliably prevented from leaking from both ends of the developing roller 31.

Accordingly, the developing roller 31 can be made of an elastic member, obtaining excellent quality images and preventing toner leakage effectively.

The laser printer 1 is provided with the developing cartridge 28 that reliably seals toner leakage as described above. Thus, toner can be prevented from spattering inside the casing 2. Thus, the operation of the laser printer 1 can be ensured, and the preferable toner sealability can be obtained even if the developing roller 31 is rotated at a high speed to increase an image forming speed.

In the embodiment described above, the sealing element 66A is a felt made of the polyester-base fibers. However, it may be a knit, fabric, hair implant, nonwoven material, and other media as long as it is made of polyester-base fibers.

<Experiment>

To conduct a durability test of the sealing element 66A in the laser printer 1, polyester-base felt and Teflon® felt were used. Toner used in the durability test was a polymerized toner having mean particle size of 9 μm. The image forming speed was 24 pages per minute, and 28,000 sheets in A4 size were used.

The polyester-base felt is made of 100% polyester fibers containing approximately 12.5 μm-thick fine fiber and approximately 25–26 μm-thick thick fiber fifty-fifty in quantity.

The Teflon® felt is made of 100% Teflon® fibers only containing approximately 24–28 μm-thick thick fiber.

The polyester-base felt and the Teflon® felt were coated with a fluorine-base lubricating agent (under the trademark of Hanarl FL-Z75, manufactured by Kanto Kasei Co., Ltd.) in advance about 25±5 g for 100 sealing elements.

The statuses of the polyester felt and the Teflon® felt after the durability test were observed under a light microscope. The status of the polyester-base felt is shown in FIG. 7, and the status of the Teflon® felt is shown in FIG. 8.

Figure 7:
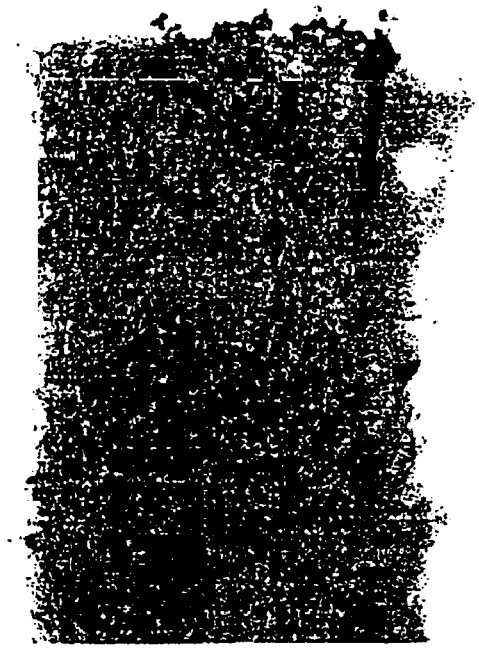
FIG. 7 is a microscope photograph showing a polyester-base felt after a durability test.
Figure 8:
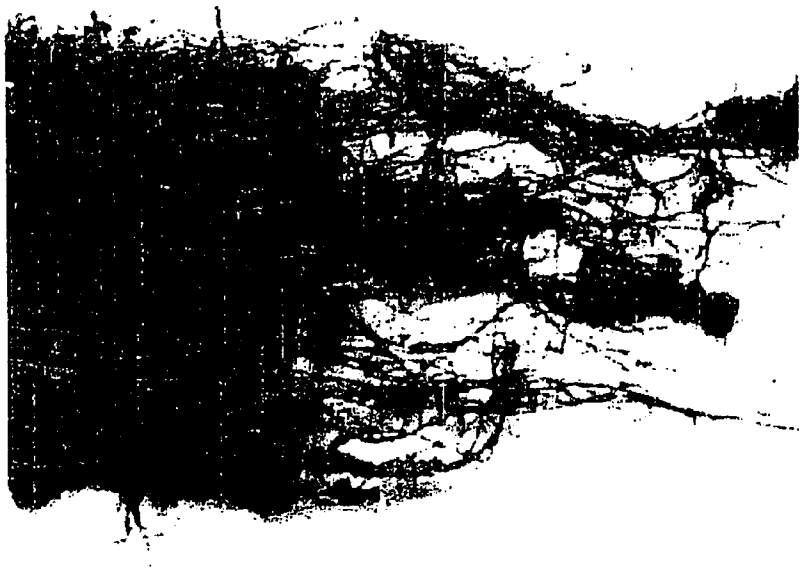
FIG. 8 is a microscope photograph showing a Teflon® felt after a durability test.

As is evident from the figures, the Teflon® felt shown in FIG. 8 sustains a great loss of fibers, while the polyester-base felt shown in FIG. 7 hardly sustains damage. In this respect, it is understood that the polyester-base felt is far superior to the Teflon® felt in the wear resistance and the durability.

In the embodiment described above, the sealing element 66B is the textile fabric 67 made of the cashmere-base fibers. Instead, a sheet member 71 made of polyimide or polyethylene terephthalate (PET) may be used for the sealing element 66B.

Figure 12A:
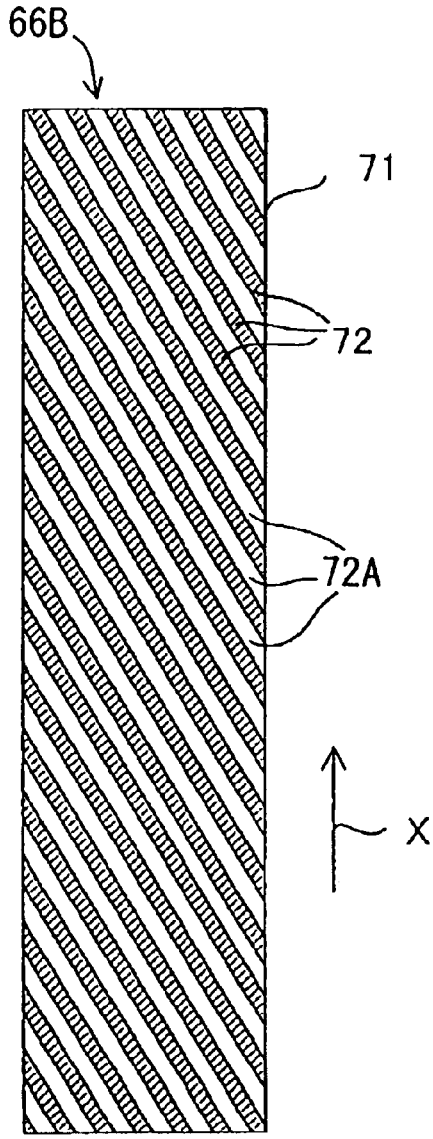
FIG. 12A is a plan view of a sealing element modified from that shown in FIG. 4C, where the sealing element is made from resin.
Figure 12B:
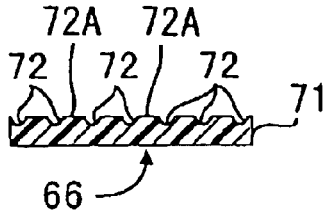
FIG. 12B is a sectional view of the sealing element of FIG. 12A.

More specifically, as shown in FIGS. 12A, 12B, the sheet member 71 is substantially rectangular, and includes a plurality of parallel recessed portions 72 on a surface where the developing roller 31 slides.

The recessed portions 72, semicircular in cross section, are formed into streaks equally separated from each other, on the entire surface of the sheet member 71 making sliding contact with the developing roller 31. The recessed portions 72 incline toward the developing chamber 34*a* with respect to the rotational direction X, that is, toward the center of the developing roller 31. The recessed portions 72 are arranged so as to incline 45° or less with respect to the rotational direction.

The sheet member 71 is affixed to the sponge seal 65 so that the recessed portions 72 lean toward the developing chamber 34*a* with respect to the rotational direction X. Projecting portions 72A formed between the adjacent recessed portions 72 stop toner conveyed from the center of the developing roller 31 to the sheet member 71 from moving further outwardly of the developing roller 31. More specifically, when the developing roller 31 is rotated, toner is conveyed along the inclination of the recessed portions 72 to the developing chamber 34*a*.

Thus, toner leakage can be reliably prevented, and sufficient toner sealability can be ensured even if the developing roller 31 is rotated at a high speed.

If the recessed portions 72 incline 45° or more with respect to the rotational direction X, a force acting on toner due to the rotation of the developing roller 31 becomes easily absorbed at the recessed portions 72. Toner passed in between the sheet member 71 and the developing roller 31 becomes difficult to move toward the developing chamber 34*a*.

As in the embodiment, if the recessed portions 72 are arranged so as to incline 45° or less with respect to the rotational direction X, the force acting on toner by the rotation of the developing roller 31 is difficult to be absorbed at the recessed portions 72, so toner passing in between the developing roller 31 and the sheet member 71 is easy to move toward the toner box 34*b*.

In the sheet member 71, toner is not intertwined in fibers as in the cashmere-base fiber textile fabric 67. Thus, toner passed in between the developing roller 31 and the sheet member 71 is mostly moved toward the developing chamber 34*a* and collected therein.

As a result, toner entering into between the sheet member 71 and the developing roller 31 can be immediately returned to the developing chamber 34*a*, thereby reliably preventing toner leakage. Further, even when the developing roller 31 is rotated at a high speed, more reliable toner sealability can be obtained.

The recessed portions 72 do not need to be inclined in a straight line. They may be formed in a circular-arc shape.

Figure 13:
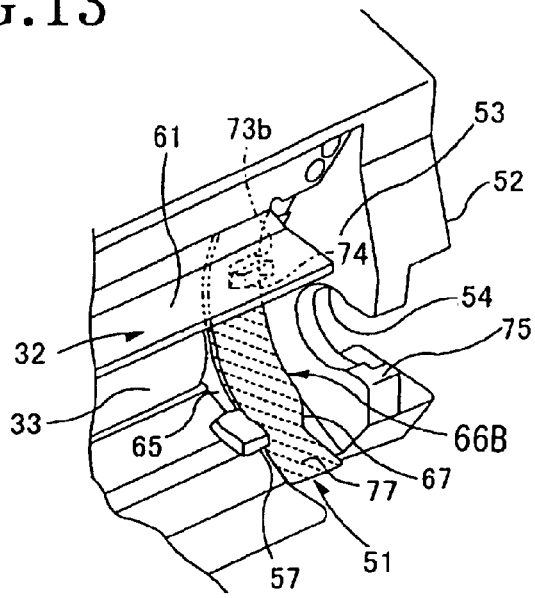
FIG. 13 is a perspective view of the substantial parts of a sealing structure modified from that shown in FIG. 3, where a frame rib formed on a side wall is engaged in a notch of the sealing element.

As shown in FIGS. 13 and 14, the sealing element 66B includes a notch 73*a*, 73*b* as an identifier. FIG. 13 shows structural elements on one end of the developing roller 31, and the following descriptions are based on one end of the developing roller 31. The structural elements at the one end are identical to those at the other end.

FIG. 13 shows the right side end of the housing 52 of the developing cartridge 28 when the opening of the housing 52 is viewed from the front. A frame rib 74 of substantially rectangular protrudes from the side wall 53 at an upper part of housing 52.

Figure 14A:
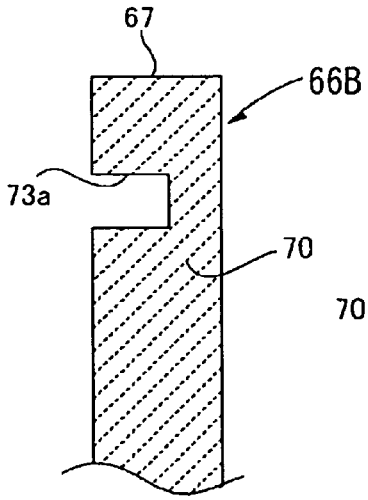
FIG. 14A is a plan view of a sealing element to be affixed to the left side end of the developing cartridge shown in FIG. 11 when an opening of the developing cartridge is viewed from a front.
Figure 14B:
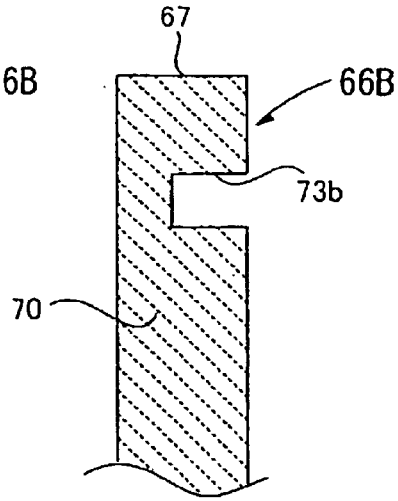
FIG. 14B is a plan view of a sealing element to be affixed to the right side end of the developing cartridge shown in FIG. 11 when the opening of the developing cartridge is viewed from the front.

The sealing element 66B includes the notch 73*b* as an identifier at the upper part thereof so as to face the frame rib 74, as shown in FIG. 14B.

The notch 73*b* is formed in a substantially rectangular shape so as to open on the right edge of the sealing element 66B (opposite side of the developing chamber 34*a*). The sealing element 66B is affixed to the sponge seal 65 in such a manner that the notch 73*b* receives the frame rib 74 therein.

FIG. 14A shows the sealing element 66B disposed on the left end of the housing 52. In this case, the notch 73*a* is formed in a substantially rectangular shape so as to open on the left edge of the sealing element 66B (opposite side of the developing chamber 34*a*). The sealing element 66B is affixed to the sponge seal 65 in such a manner that the notch 73*a* receives the frame rib 74 therein.

As described above, the sealing element 66B is made of the textile fabric 67 where the protruding weaving seams 77 are formed in a stepped arrangement in a fixed direction with respect to the rotational direction X. If the right and left sealing elements 66B are misplaced, toner passing in between each of the sealing element 66B and the developing roller 31 is conveyed in a direction opposite to the developing chamber 34*a* along the protruding seams 77, and consequently, toner leaks.

However, as the notches 73*a*, 73*b* are formed in the sealing elements 66B, the right and left sealing elements 66B can be placed by engaging in the frame ribs 74, thereby effectively preventing the misplacement. Thus, the sealing elements 66B can be reliably placed in position and toner leakage can be also reliably prevented.

To identify the right and left sealing elements 66B, the sealing elements 66B may be different from each other in width.

Figure 16:
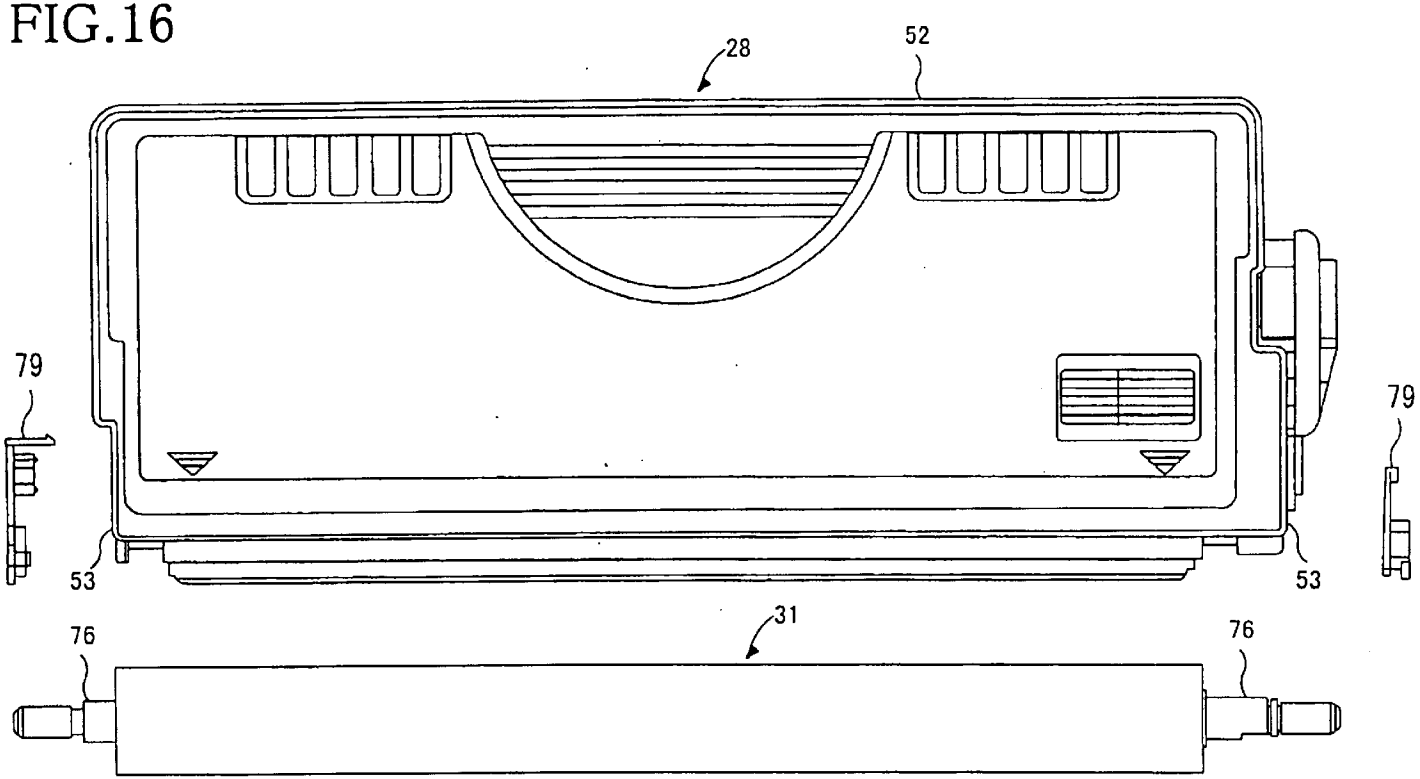
FIG. 16 is a plan view of the developing cartridge before the developing roller is mounted.
Figure 17:
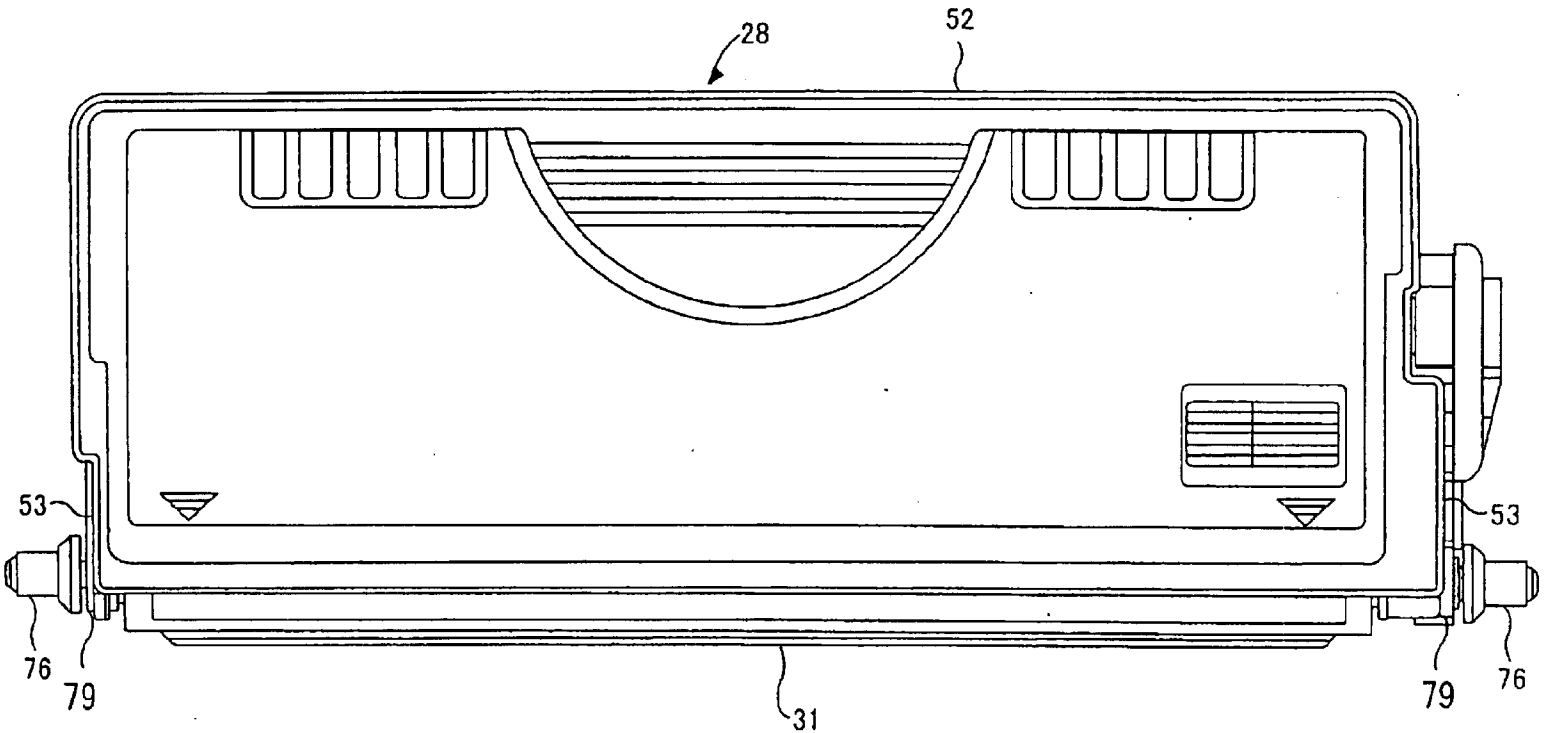
FIG. 17 is a plan view of the developing cartridge after the developing roller is mounted.

Referring to FIGS. 16 and 17, a method to mount the developing roller 31 in the developing cartridge 28 will be described.

As shown in FIG. 16, the side seals 51 are placed on both ends of the housing 52 of the developing cartridge 28. The developing roller 31 is oriented, in front of the developing cartridge 28, so that the width direction of the housing 52 is in face-to-face relation with the axial direction of the developing roller 31, and moved toward the housing 52, in a direction substantially perpendicular to the width of the housing 52, toward the housing 52. The roller shaft 76 of the developing roller 31 is inserted into the support holes 54 of the side walls 53 on both sides of the housing 52, so that the developing roller 31 is located on the side seals 51.

Bearings 79 are attached to both ends of the roller shaft 76 of the developing roller 31 from outside both side walls 53 of the housing 52, so that, as shown in FIG. 17, the developing roller 31 is mounted in the developing cartridge 28.

If the developing roller 31 is inserted in the housing 52 from the width direction of the housing 52, the surface of each of the side seals 51 is rubbed along the axial direction of the developing roller 31 due to sliding contact with the circumferential surface of the developing roller 31. By friction due to the sliding contact, the sealing elements 66A, 66B on the side seals 51 are deformed toward the axial direction of the developing roller 31.

However, in this embodiment, the developing roller 31 is placed on the side seals 51 from the direction perpendicular to the width of the housing 52. In other words, the developing roller 31 is inserted in a direction of the long side of the side seals 51.

Thus, the sealing elements 66A, 66B are not rubbed in the axial direction of the developing roller 31 although they receive a pressing force of the developing roller 31 from the direction of the long side of the sealing elements 66A, 66B. Thus, the side seals 51 are not deformed in the axial direction of the developing roller 31. In this way, the developing roller 31 can be mounted in the housing 52 such that toner should not leak.

To avoid increasing the size of the developing cartridge 28, the side seals 51 should be formed as narrow as possible. If the side seals 51 are made narrow, they are liable to deform by a force from the width direction of the housing 52. Therefore, to mount the developing roller 31 from the width direction of the housing 52, the side seals 51 should have rigidity as to width direction.

However, when the developing roller 31 is mounted as in this embodiment, the side seals 51 does not need increase in rigidity, and the developing roller 31 can be easily mounted so that toner should not leak out.

What is claimed is:

1. A developing agent container, comprising:

a housing that accommodates a developing agent;

a feeding element that feeds the developing agent from the housing; and a sealing element provided at an end of an inside of the housing with respect to an axial direction of the feeding element when mounted in the housing in position, wherein the sealing element prevents the developing agent from leaking from the housing, and the sealing element is made of fibers in which a thickness of each of the fibers is smaller than or equal to approximately 2.1 times as large as a mean particle diameter of the developing agent.

2. The developing agent container according to claim 1, wherein the fibers are polyester-base fibers.

3. The developing agent container according to claim 2, wherein the polyester-base fibers include at least two different kinds of the polyester-base fibers in thickness, a fine fiber and a thick fiber.

4. The developing agent container according to claim 3, wherein the fine fiber constitutes 30% or more of a total of the polyester-base fibers that make up the sealing element.

5. The developing agent container according to claim 1, wherein a surface of the sealing element makes sliding contact with a surface of the feeding element, and the surface of the sealing element is coated with a lubricating agent.

6. The developing agent container according to claim 5, wherein the lubricating agent is a fluorine-base lubricating agent that includes a fluorine oil and a fluorine-base resin.

7. The developing agent container according to claim 1, wherein the developing agent is formed into a substantially circular shape and prepared by polymerization.

8. A developing agent container, comprising:

a housing that accommodates a developing agent;

a feeding element that feeds the developing agent from the housing; and a sealing element provided at an end of an inside of the housing with respect to an axial direction of the feeding element when mounted in the housing in position, wherein the sealing element prevents the developing agent from leaking from the housing, and the sealing element is made by weaving fibers, the sealing element includes weaving seams to move the developing agent conveyed on a surface of the sealing element in a fixed direction, and the sealing element is woven with vertical threads and horizontal threads such that each of the vertical threads passes over at least two adjacent ones of the horizontal threads.

9. The developing agent container according to claim 8, wherein the weaving seams are woven into the sealing element so as to move the developing agent toward the housing.

10. The developing agent container according to claim 9, wherein the fixed direction that the developing agent moves along the weaving seams of the sealing element inclines 45° or less with respect to a direction that the feeding element conveys the developing agent.

11. The developing agent container according to claim 8, wherein the weaving seams are formed such that two adjacent ones of the vertical threads pass over at least one common one of the horizontal threads, one of the two adjacent ones of the vertical threads passes over a next adjacent one of the horizontal threads following the common one of the horizontal threads, and the other one of the two adjacent ones of the vertical threads passes under the next adjacent one of the horizontal threads.

12. The developing agent container according to claim 11, wherein a direction of the vertical threads woven into the sealing element is substantially the same as a direction that the feeding element conveys the developing agent.

13. The developing agent container according to claim 12, wherein the sealing element is cut into a rectangle to make a long side of the rectangle oriented toward the direction of the vertical threads woven into the sealing element.

14. The developing agent container according to claim 8, wherein the fibers are cashmere-base fibers in which a thickness of each of the cashmere-base fibers is smaller than or equal to approximately 2.1 times as large as a mean particle diameter of the developing agent.

15. The developing agent container according to claim 8, wherein the surface of the sealing element makes sliding contact with a surface of the feeding element and is coated with a lubricating agent.

16. The developing agent container according to claim 15, wherein the lubricating agent is a fluorine-base lubricating agent that includes a fluorine oil and a fluorine-base resin.

17. The developing agent container according to claim 8, wherein the developing agent is formed into a substantially circular shape and prepared by polymerization.

18. A developing agent container, comprising:

a housing that accommodates a developing agent;

a feeding element that feeds the developing agent from the housing; and a sealing element provided at an end of an inside of the housing with respect to an axial direction of the feeding element when mounted in the housing in position, wherein the sealing element prevents the developing agent from leading from the housing, and the sealing element includes a regulator so that the developing agent at the sealing element is fed to a predetermined direction, the regulator is formed so as to feed the developing agent toward the housing, and the predetermined direction that the regulator of the sealing element moves the developing agent inclines 45° or less with respect to a direction that the feeding element conveys the developing agent.

19. The developing agent container according to claim 18, wherein a surface of the sealing element makes sliding contact with a surface of the feeding element, and is coated with a lubricating agent.

20. The developing agent container according to claim 19, wherein the lubricating agent is a fluorine-base lubricating agent that includes a fluorine oil and a fluorine-base resin.

21. The developing agent container according to claim 18, wherein the developing agent is formed into a substantially circular shape and prepared by polymerization.

22. The developing agent container according to claim 18, wherein the feeding element feeds the developing agent in the direction perpendicular to the axial direction thereof, and the sealing element is provided so as to make contact with the feeding element at an end with respect to the axial direction thereof.

23. The developing agent container according to claim 22, wherein the sealing element is formed with an identifier.

24. The developing agent container according to claim 23, wherein the identifier is formed by a notch.

25. A developing agent container, comprising:

a housing that accommodates a developing agent;

a feeding element that feeds the developing agent from the housing; and a sealing element provided at an end of an inside of the housing with respect to an axial direction of the feeding element when mounted in the housing in position, wherein the sealing element that prevents the developing agent from leaking from the housing, the sealing element includes at least two different kinds of fibers in thickness, a fine fiber and a thick fiber, and the fine fiber constitutes 30% or more of a total of the fibers that make up the sealing element.

26. The developing agent container according to claim 25, wherein a surface of the sealing element makes sliding contact with a surface of the feeding element, and the surface of the sealing element is coated with a lubricating agent.

27. The developing agent container according to claim 26, wherein the lubricating agent is a fluorine-base lubricating agent that includes a fluorine oil and a fluorine-base resin.

28. The developing agent container according to claim 25, wherein the developing agent is formed into a substantially circular shape and prepared by polymerization.

29. A developing agent container, comprising:

a housing that accommodates a developing agent;

a feeding element that feeds the developing agent from the housing; and a sealing element provided at an end of an inside of the housing with respect to an axial direction of the feeding element when mounted in the housing in position, wherein the sealing prevents the developing agent from leaking from the housing, and the sealing element includes a regulator having a plurality of recessed portions and a plurality of projecting portions so that the developing agent at the sealing element is fed to a predetermined direction, the plurality of recessed portions are parallel to one another and are formed on a surface of the sealing element, the surface of the sealing element makes sliding contact with a surface of the feeding element, and each one of the plurality of recessed portions is semicircular in cross section.

30. The developing agent container according to claim 29, wherein the sealing element is a sheet member made from the group consisting of polyimide or polyethylene terephthalate.

31. The developing agent container according to claim 29, wherein the plurality of projecting portions are parallel to the plurality of recessed portions, and each one of the plurality of projecting portions is formed between adjacent ones of the plurality of recessed portions.

32. The developing agent container according to claim 29, wherein the plurality of recessed portions and the plurality of projecting portions are inclined 45° or less with respect to a direction that the feeding element conveys the developing agent.

33. A developing agent container, comprising:

a housing that accommodates a developing agent;

a feeding element that feeds the developing agent from the housing; and a sealing element provided at an end of an inside of the housing with respect to an axial direction of the feeding element when mounted in the housing, the sealing element is a sheet member made of resin, wherein the sealing element includes a plurality of recessed portions and a plurality of projecting portions so that the developing agent at the sealing element is fed to a predetermined direction.

34. The developing agent container according to claim 33, wherein the sheet member is made from the group consisting of polyimide or polyethylene terephthalate.

35. The developing agent container according to claim 33, wherein the plurality of recessed portions are formed into streaks separated from each other.

36. The developing agent container according to claim 35, wherein the plurality of the recessed portions are parallel to one another and are formed on a surface of the sheet member, wherein the surface of the sheet member makes sliding contact with a surface of the feeding element.

37. The developing agent container according to claim 36, wherein the plurality of the recessed portions are inclined 45° or less with respect to a direction that the feeding element conveys the developing agent.

38. The developing agent container according to claim 36, wherein each one of the plurality of the projecting portions is formed between adjacent ones of the plurality of recessed portions.

39. The developing agent container according to claim 35, wherein each one of the plurality of the recessed portions is semicircular in cross section.

* * * * *